US007353676B2

(12) United States Patent
Hartmann et al.

(10) Patent No.: US 7,353,676 B2
(45) Date of Patent: Apr. 8, 2008

(54) METHOD AND APPARATUS FOR PRECISION ROLLING OF ROTATIONALLY SYMMETRICAL COMPONENTS

(75) Inventors: Gunther Hartmann, Alsfeld (DE); Wolfgang Sommer, Gemünden (DE); Mario Braun, Mücke (DE); Matthias Becker, Alsfeld-Billertshausen (DE)

(73) Assignee: KAMAX-Werke Rudolf Kellermann GmbH & Co. KG, Osterode am Harz (DE)

( * ) Notice: Subject to any disclaimer, the term of this patent is extended or adjusted under 35 U.S.C. 154(b) by 0 days.

(21) Appl. No.: 11/284,454

(22) Filed: Nov. 21, 2005

(65) Prior Publication Data

US 2006/0107717 A1 May 25, 2006

(30) Foreign Application Priority Data

Nov. 25, 2004 (DE) ..... 10 2004 056 921

(51) Int. Cl.
*B21B 37/68* (2006.01)

(52) U.S. Cl. ..... 72/7.6; 72/11.6; 72/108

(58) Field of Classification Search ..... 72/7.1, 72/7.6, 8.3, 8.9, 11.1, 11.6, 12.7, 88, 102, 72/104, 108, 31.08
See application file for complete search history.

(56) References Cited

U.S. PATENT DOCUMENTS 3,839,892 A * 10/1974 Andriessen ..... 72/108
4,132,098 A * 1/1979 Culver et al. ..... 72/102
4,170,050 A * 10/1979 Bosse ..... 470/10
4,343,167 A * 8/1982 Hasegawa et al. ..... 72/10.7
5,497,642 A * 3/1996 Greis ..... 72/19.9
6,418,767 B2 * 7/2002 Shinbutsu et al. ..... 720/10.2
6,915,673 B2 * 7/2005 Shinbutsu et al. ..... 72/104
2003/0226386 A1 12/2003 Ladousse et al. ..... 72/108

FOREIGN PATENT DOCUMENTS

| | | | |
|---|---|---|---|
| CH | 692 385 | A5 | 5/2002 |
| DE | 31 10 433 | A1 | 2/1983 |
| DE | 288 787 | A5 | 11/1989 |
| DE | 196 53 569 | A1 | 7/1998 |
| GB | 2 098 901 | A | 12/1982 |
| WO | WO 02/078874 | A1 | 10/2002 |

* cited by examiner

*Primary Examiner*—Ed Tolan
(74) *Attorney, Agent, or Firm*—Thomas, Kayden, Horstemeyer & Risley, LLP

(57) ABSTRACT

An apparatus (1) and a method serve for precision rolling of a surface area (2) of a rotationally symmetrical component (3), especially a screw. The apparatus (1) includes at least two spaced apart rolling tools (4, 5), a measuring unit (9) for determining an actual blank diameter of the component (3), an evaluating unit (10) for comparing the determined actual blank diameter of the component (3) with a predetermined blank diameter and for determining an adjustment value from the result of the comparison, and a control unit (11) for adjusting a distance between the at least two rolling tools (4, 5) in response to the adjustment value.

22 Claims, 6 Drawing Sheets

METHOD AND APPARATUS FOR PRECISION ROLLING OF ROTATIONALLY SYMMETRICAL COMPONENTS

CROSS REFERENCE TO RELATED APPLICATIONS

This application claims priority to co-pending German Patent Application No. DE 10 2004 056 921.5 entitled "Verfahren und Vorrichtung zum Präzisionsrollen von rotations-symmetrischen Bauteilen", filed Nov. 25, 2004.

FIELD OF THE INVENTION

The present invention generally relates to an apparatus for precision rolling of a surface area of a rotationally symmetrical component by at least two spaced apart rolling tools. The present invention also relates to a method for precision rolling of a surface area of a rotationally symmetrical component by at least two spaced apart rolling tools.

More particularly, the novel apparatus and method serve to produce profiled sections of a component or to finish profiled sections of a component, for example by calibrating. For example, the rotationally symmetrical component may be a worm wheel, an injection valve, a press fit shaft section, and the like. Preferably, the component is a fastener, especially a screw. For example, the profiled section may be a thread, a helix, a knurled portion, a grooved section, a helical profile or a toothed section. In addition to the production or finishing of profiled sections, it is also possible to produce or to finish non-profiled sections, especially by finish rolling of a smooth surface area of the component.

BACKGROUND OF THE INVENTION

An apparatus and a method for precision rolling of a surface area of a rotationally symmetrical component by at least two spaced apart rolling tools and a unit for determining the actual blank diameter of the component are known from German Patent Application No. DE 31 10 433 A1 corresponding to British Patent Application No. GB 2 098 901 A The comparison of the actual blank diameter of the component and the desired blank diameter of the component is used as a decision criterion on passing or rejecting a component.

A profile rolling machine for deforming the surface area of rotationally symmetrical components is known from Swiss Patent No. CH 692 385 A5. The known profile rolling machine includes a machine base on which guiding rails for slides are mounted. The slides support rolling tools being designed as rolling heads, and they are movably supported along the guiding rails such that the distance between the rolling tools is adjustable by a relative movement of the slides with respect to one another along the guiding rails. The profile rolling machine further includes a load frame including two adjacent joke plates being arranged at the ends. The load frame is supported on the machine base to be movable in the direction of movement of the slides such that the machine base is decoupled from the load frame such that low rolling forces have to be accepted during deformation of a component. The known profile rolling machine includes a length measuring unit being located at the machine base. The position of the movable slide with respect to the machine base can be measured by the length measuring unit. Furthermore, there is a control unit which corrects the position of the rolling tools with respect to one another in response to possible length extensions of the load frame. Generally, the design of the known profile rolling machine is based on the concept of decoupling the machine base including the length measuring unit from the load frame including the rolling tools in a way that readjustment of the distance between the rolling tools in response to the distance measured between the rolling tools by the length measuring unit during rolling.

A method and an apparatus for finish rolling of smooth rotationally symmetrical components are known from East German Patent No. DD 288 787 A5. A numeric control machine tool includes a tool holder in which a rolling tool subjected to the force of a spring is located. A length measuring unit including electric contacts is connected to the shank of the rolling tool. The length measuring unit is connected to the control of the numeric control machine tool. The rolling force depending on the work piece and on the material of the work piece is adjusted in the desired tolerance range in the length measuring unit under consideration of the spring characteristic of the rolling tool. Deformation of the spring element in the rolling tool during rolling is used as an indirect measure of the occurring rolling force, and it is sensed by the length measuring unit. When the adjusted tolerance range is exceeded, pulses are initiated, the pulses being used to control the rolling force. Thus, it is desired to reach a rolling force which is as constant as possible no matter what the shape of the blank of the component is.

SUMMARY OF THE INVENTION

The present invention relates to an apparatus for precision rolling of a surface area of a rotationally symmetrical component. The apparatus includes at least two spaced apart rolling tools, a unit for determining an actual blank diameter of the component, a unit for comparing the determined actual blank diameter of the component with a predetermined blank diameter and for determining an adjustment value from the result of the comparison, and a control unit for adjusting a distance between the at least two rolling tools in response to the adjustment value.

The present invention also relates to an apparatus for rolling a surface area of a rotationally symmetrical component, especially a fastener. The apparatus includes at least two spaced apart rolling tools, a measuring unit, an evaluating unit and a control unit. The rolling tools are designed and arranged to machine at least a section of the surface area of the component by rolling. The rolling tools are designed and arranged such that a distance between the rolling tools is adjustable by moving the rolling tools with respect to one another. The measuring unit is designed and arranged to determine an actual blank diameter of the component. The blank diameter is a diameter of the component before rolling. The evaluating unit is designed and arranged to associate the determined actual blank diameter of the component to an adjustment value. The adjustment value is contained in a specific group of a plurality of groups. Each of the groups is associated with a plurality of predetermined blank diameters of the component. The control unit is designed and arranged to adjust the distance between the at least two rolling tools depending on the adjustment value.

The present invention also relates to a method of precision rolling of a surface area of a rotationally symmetrical component. The method includes the steps of determining an actual blank diameter of the component, comparing the determined actual blank diameter of the component with a predetermined blank diameter, determining an adjustment value from the result of the step of comparing, adjusting a distance between at least two rolling tools in response to the adjustment value, and machining at least a section of the surface area of the component by rolling.

The component to be processed by rolling is located between at least two spaced apart rolling tools, and it is machined in accordance with the shape of the rolling tools. During processing of the surface area of the component, there is the problem of the rolling tools being pressed away from one another due to the counterforce applied by the component. In prior art methods and apparatuses, this leads to the fact that the actual finished part diameter of the component substantially differs from the desired finished part diameter of the component in a way that the required process safety is not attained. This drawback is effectively overcome by the present invention.

The novel unit for determining the actual blank diameter of the component may be designed as a measuring unit. However, it may also be designed as an interface of the apparatus to be connected to a (separate) measuring unit. The unit for comparing the actual blank diameter of the component to the predetermined blank diameter and for determining an adjustment value from the result of the comparison of the actual blank diameter of the component to the predetermined blank diameter may be designed as an evaluating unit. However, it may also be designed as an interface of the apparatus to be connected to a (separate) evaluating unit. In other words, the apparatus does not need to include the measuring unit and/or the evaluating unit. The apparatus only needs to be designed such that data coming from a measuring unit can be transmitted to an evaluating unit and further to the control unit of the apparatus.

The novel method of precision rolling of a surface area of a rotationally symmetrical component on a rolling machine at first senses and determines the actual blank diameter of the component. Then, the actual blank diameter of the component is compared to a predetermined blank diameter, and an adjustment value is determined from the result of the comparison of the actual blank diameter of the component with the predetermined blank diameter. Next, the distance between the at least two rolling tools is adjusted in response to the adjustment value.

The present invention is based on the findings that the efforts known in the prior art to realize a distance between the rolling tools which is as constant as possible in the sense of an almost constant working end position of the rolling machine and great stiffness of the rolling machine do not lead to the required exactness of the finished part diameter of the component. The present invention intentionally leaves this prior art concept, and it replaces it by the concept of controlling the distance between the rolling tools in response to the result of the determination of the actual blank diameter of the component before being processed.

This novel concept of controlling the distance between the rolling tools in response to and depending on an adjustment value being based on the determined actual blank diameter of the component is based on the following findings: if a production lot of n components is to be rolled precisely and m components have an actual blank diameter in the range of the lower tolerance (meaning they are comparatively thin), one can observe that these m components also have a smaller diameter after precision rolling compared to the other "thicker" components. In other words, a "thin" component remains "thin" after precision rolling, and a "thick" component remains comparatively "thick" after precision rolling. The diameters of the components approximately have the same relation, the range in which the components are located being slightly decreased by precision rolling. For example, in a range of approximately 0.1 mm of the variation of the blank diameters, the decrease of the range is less than approximately 0.02 mm relating to the finished part diameters of the components. This leads to the conclusion that elastic deformation of the components during deformation increases during rolling.

The determined actual blank diameter of the component may be associated to a specific group of a plurality of groups, each of the groups containing a specific adjustment value. In this way, one attains the advantage of the control expenditure and the adjustment expenditure being minimized while still realizing sufficient exactness of the finished part diameter of the components. In this way, it is not necessary to move the rolling tools to a different position for each different component. The number of groups and the classification of groups or classes are realized depending on the tolerance of the blank diameters and the accepted finished part diameters of the components. Alternatively, the adjustment value can also be determined according to a mathematical function being specific for the machine or the material to be deformed.

The adjustment values may be determined based on a comparison of a determined actual finished part diameter of the component with a predetermined desired finished part diameter for each one of the plurality of groups. In other words, a characteristic curve of the respective rolling machine, the respective material and of the respective shape and geometry of the component is determined. For reasons of simplification, one may use the classification of the blank diameters.

For example, the measuring unit may be located in an automatic feeding unit for the components. It is possible to arrange the measuring unit and the actual apparatus for precision rolling (i.e. the rolling machine) at different places. The measuring unit does not necessarily have to be a direct part of the apparatus. One only needs to make sure that the measuring unit is associated with the evaluating unit in a way that the measuring data is electrically and electronically, respectively, transmitted such that the evaluating unit can determine the adjustment value based on the data, and such that it can transmit the adjustment value to the control unit for adjusting the distance between the at least two rolling tools. It is to be understood that the evaluating unit may also be designed and arranged to be separate from the apparatus.

For example, the measuring unit may be designed as a mechanical measuring unit or as an optical measuring unit. When using a mechanical measuring unit, the diameter of the component may be determined by a mechanical tracer, for example. When using an optical measuring unit, it may include light barriers or cameras, for example. The component to be deformed by rolling may especially be a fastener, preferably a screw. For screws, especially rolling of profiled sections is a common case of application. The shank of a screw is cold formed by rolling, for example to produce a thread, a helix being located in a fitting portion or a knurled element.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
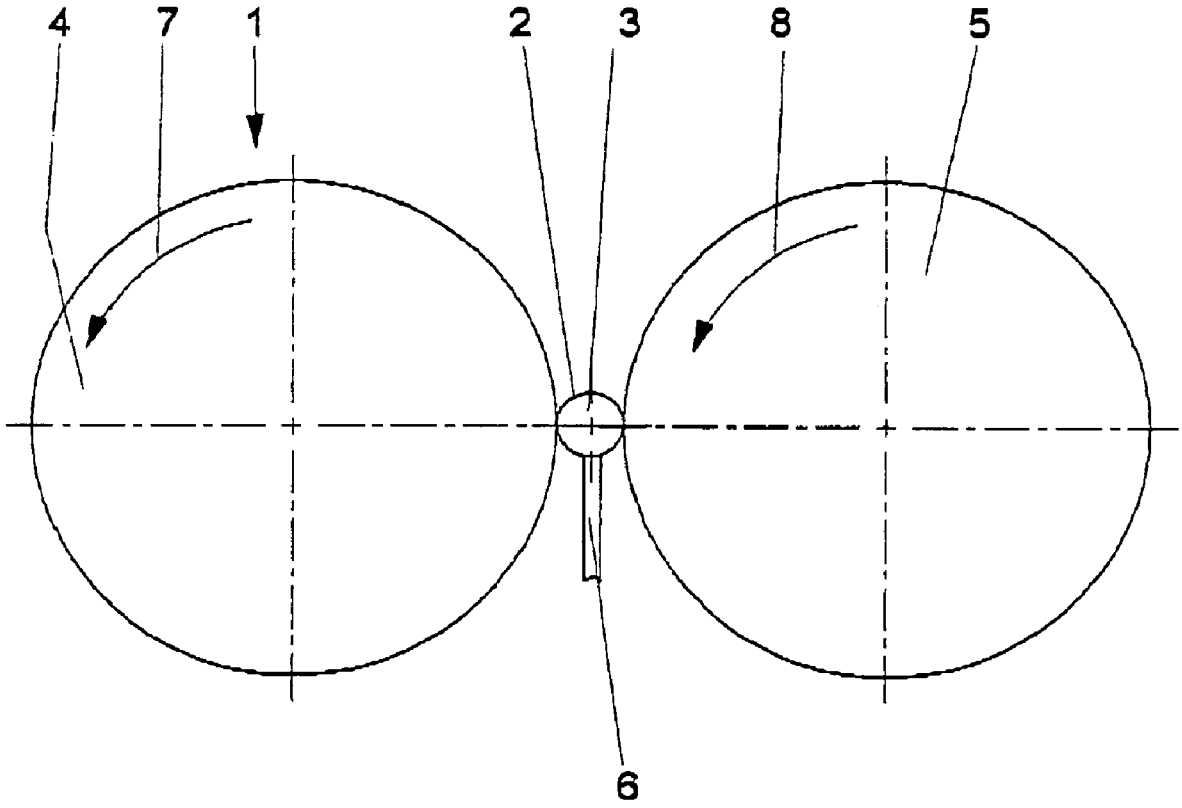
FIG. 1 is a schematic view of a novel apparatus for precision rolling of the surface area of a rotationally symmetrical component.

Referring now in greater detail to the drawings, FIG. 1 illustrates the simplified general design and functionality of a novel apparatus 1 for precision rolling of a surface area 2 of a rotationally symmetrical component 3. The apparatus 1 includes two spaced apart rolling tools 4 and 5. Furthermore, there is a support 6 serving to support the component 3. The rolling tools 4, 5 have a shape corresponding to the shape of the surface area 2 of the component 3 to be produced. The rolling tools 4, 5 are driven by a drive in a known way (not illustrated) to rotate in the same sense of rotation according to arrows 7 and 8. At least one of the rolling tools 4, 5 is arranged in a way to be movable such that the distance between the rolling tools 4, 5 is adjustable. It is also possible to design and arrange both rolling tools 4, 5 to be movable. Furthermore, it is possible to arrange three or more rolling tools between which the component 3 is located and by which the outer shape of the component 3 is formed. In the illustrated embodiment, the support 6 is designed to be stationary. However, the support 6 may also be designed to be movable (for example as a rolling cage) to increase processing speed. The general functionality of the apparatus 1 and of a rolling machine, respectively, is well known in the art such that it is not necessary to explain it herein in great detail. The novel aspects of the functionality of the novel apparatus 1 will especially be described with reference to FIGS. 3 to 6.

Figure 2:
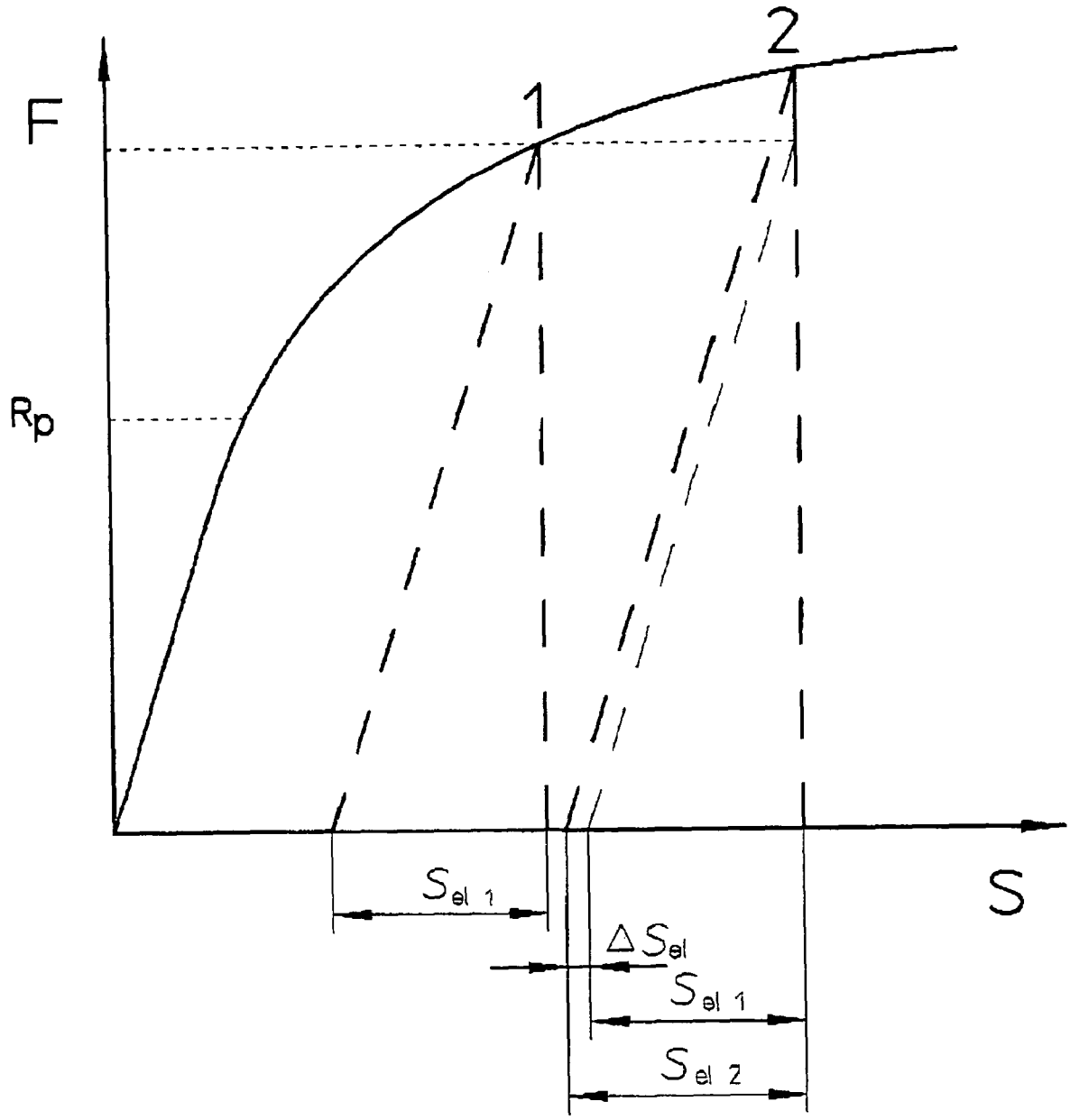
FIG. 2 is a diagram illustrating the force applied by the rolling tools versus the path of deformation of the component.

FIG. 2 is a diagram of the force (F) versus the distance or path (S). FIG. 2 serves to emphasize the general perceptions on which the present invention is based. The diagram illustrates the change S of the diameter and of the path, respectively, of a component versus the force F applied by the rolling tools 4, 5. The processed component is made of a material having no specific yield point. It is to be seen from the diagram of FIG. 2 that the component (after being deformed below the yield point $R_e$ and $R_p$, respectively, and after being released elastically) returns to reach its starting dimensions according to the straight line in accordance with Hooke's law. However, when the component is stressed beyond the point $R_p$, there are plastic deformations in addition to the elastic deformations. Due to the fact that the modulus of elasticity of a material is constant, elastic springback also occurs according to the straight line in accordance with Hooke's law. For point 1 illustrated in FIG. 2, this means that there is the elastic springback designated with $S_{el\ 1}$. When a component is stressed to reach point 2 and it has elastically returned about $S_{el\ 2}$, it is to be seen in FIG. 2 that the value of the springback $S_{el\ 2}$ differs by $\Delta S_{el}$.

If one applies these findings to the process of precision rolling (see FIG. 1), this means the following: a first component 3 having a first blank diameter is elastically and plastically deformed in the apparatus 1 by the rolling tools 4, 5 until point 1 is reached. After being released from forces, it resiliently returns by the value $S_{el\ 1}$. When a second component 3 having a greater blank diameter is elastically and plastically deformed in the apparatus 1 by the rolling tools 4, 5 having the same position, there is a greater deformation force corresponding to point 2. Elastic springback $S_{el\ 2}$ of the second component 3 is greater than elastic springback $S_{el\ 1}$ of the first component 3 having a smaller blank diameter by the value $\Delta S_{el}$. The diameter of the finished part of the second component 3 is also greater than the one of the first component 3 by $\Delta S_{el}$. Thus, one may realize that different diameters of the finished parts are attained when using different blank diameters no matter how great the stiffness of the apparatus 1 is when the same relative position of the rolling tools 4, 5 with respect to one another is used. The present invention is based on these findings.

Figure 3:
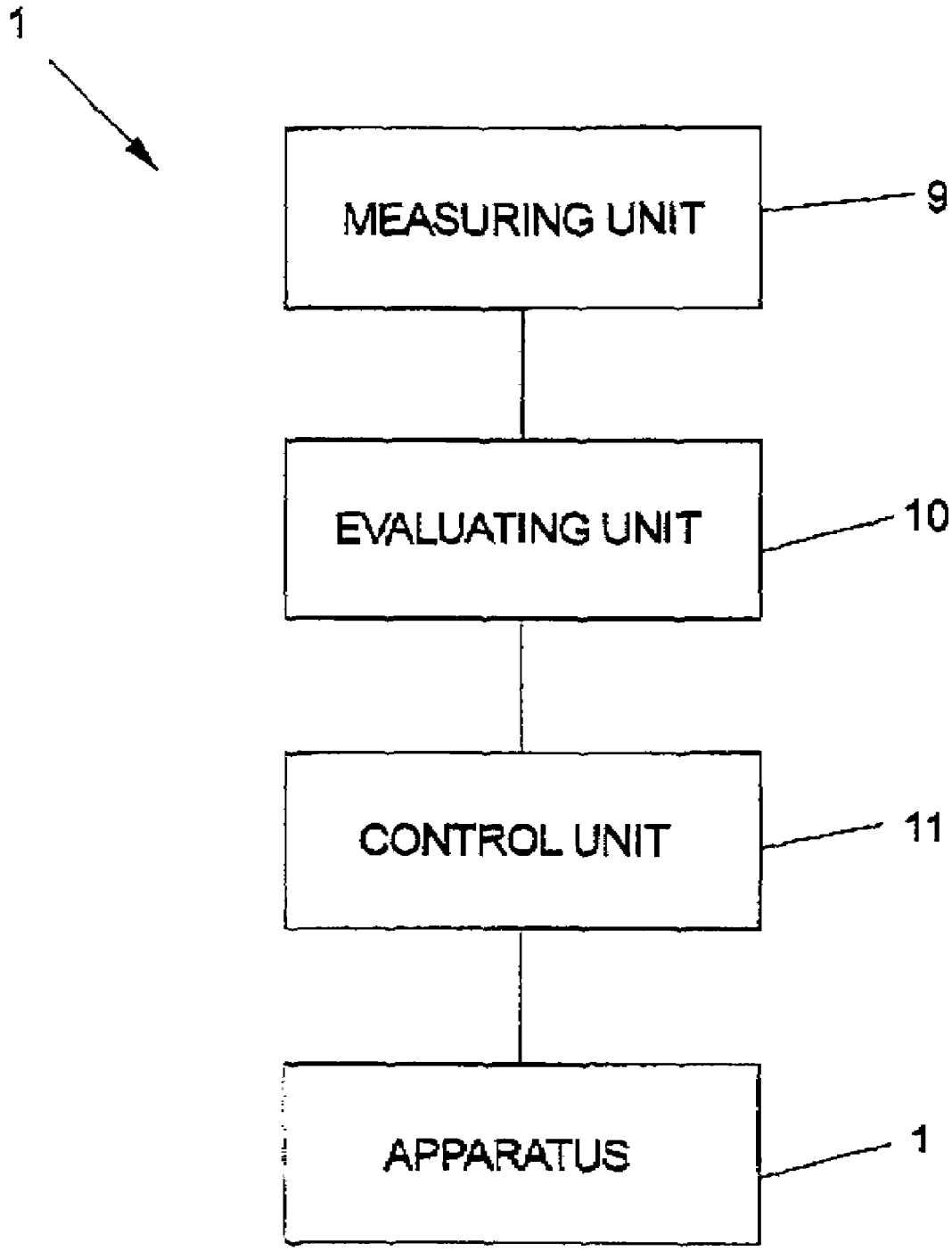
FIG. 3 is a schematic block diagram of a first exemplary embodiment of the novel apparatus for precision rolling of the surface area of a rotationally symmetrical component.

The novel control principle of the apparatus 1 and of the method of precision rolling of the surface area 2 of a rotationally symmetrical component 3 conducted by the apparatus 1 are explained in greater detail in the following with respect to FIG. 3. The apparatus 1 includes a measuring unit 9 for measuring the actual blank diameter of the component 3. The measuring unit 9 is connected to an evaluating unit 10. The evaluating unit 10 serves to compare the sensed actual blank diameter of the component 3 with a predetermined blank diameter and to determine an adjustment value from the result of the comparison of the actual blank diameter of the component 3 and the predetermined blank diameter. The evaluation unit 10 is connected to a control unit 11. The control unit 11 serves to adjust the distance between the rolling tools 4, 5 in response to the adjustment value.

However, it is also possible to design and arrange the apparatus 1 to be separate from the measuring unit 9 and/or from the evaluating unit 10. In such a case, the apparatus 1 and its control unit 11, respectively, has a respective interface. The measuring unit 9 does not have to be designed as a direct component of the apparatus 1. The measuring unit 9 is associated with the evaluating unit 10 such that the units 9, 10 are connected to transmit the sensed data electrically and electronically, respectively. In this way, the evaluating unit 10 determines the adjustment value based on the sensed data, and it transmits the adjustment value to the control unit 11 for adjustment of the distance between the at least two rolling tools 4, 5.

Figure 4:
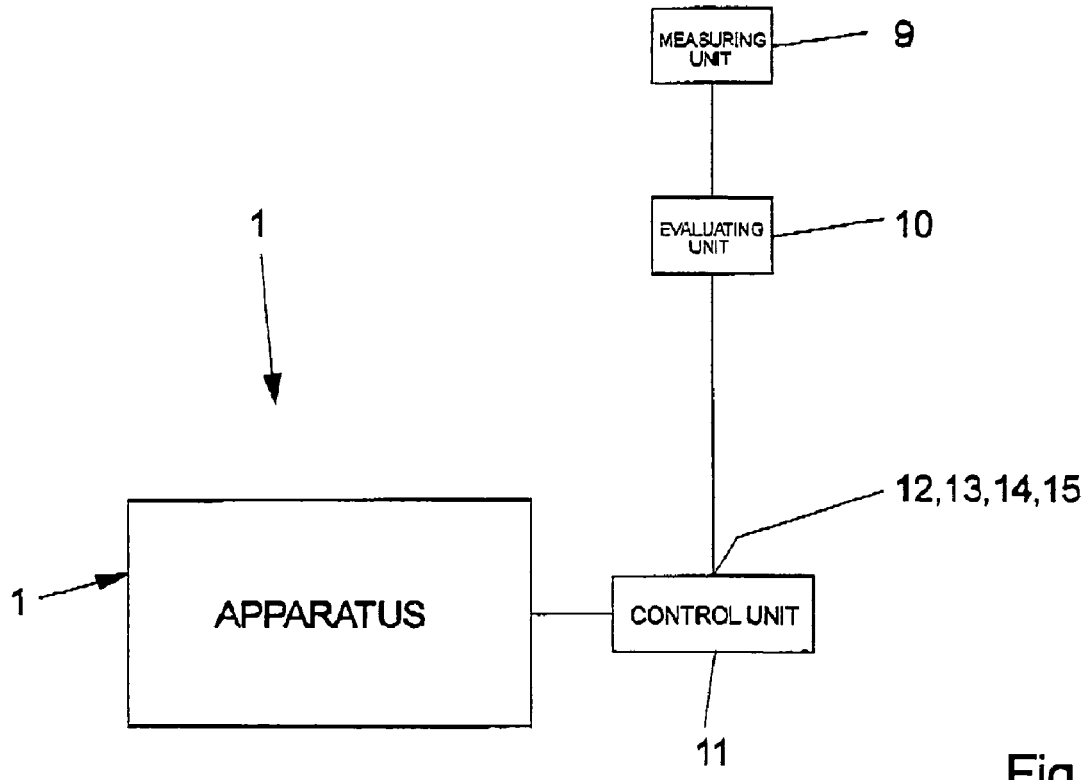
FIG. 4 is a schematic block diagram of a second exemplary embodiment of the novel apparatus for precision rolling of the surface area of a rotationally symmetrical component.

A first exemplary embodiment of the novel apparatus 1 is illustrated in greater detail in FIG. 4. The control unit 11 includes a unit 12 being designed as an interface 13 to the measuring unit 9 and a unit 14 being designed as an interface 15 to the evaluating unit 10. It is to be understood that FIG. 4 does not illustrate the exact electric and electronic, respectively, connection of the components of the apparatus 1, but rather their logical arrangement.

Figure 5:
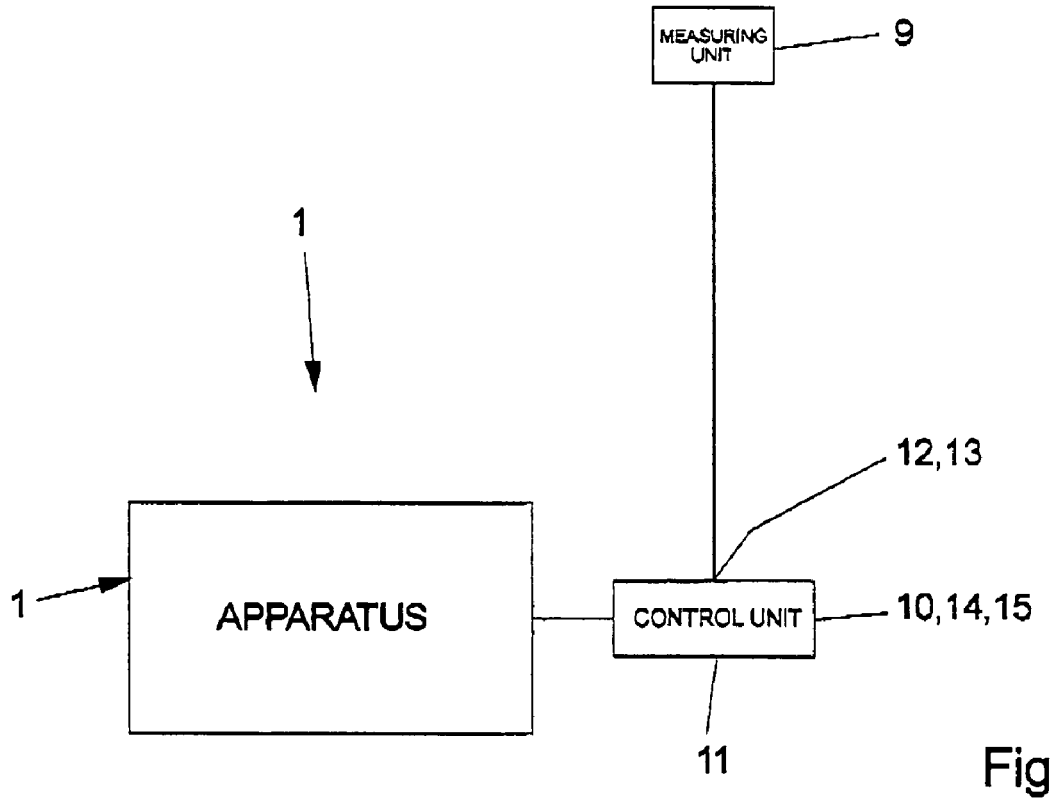
FIG. 5 is a schematic block diagram of a third exemplary embodiment of the novel apparatus for precision rolling of the surface area of a rotationally symmetrical component.

Another exemplary embodiment of the novel apparatus 1 is illustrated in FIG. 5. The apparatus 1 and its control unit 11, respectively, include the unit 12 being designed as an interface 13 to the measuring unit 9. In the illustrated exemplary case, the unit 14 is part of the control unit 11 such that the interface 15 preferably is implemented in software.

Preferably, in an initiating step, one first determines a characteristic curve relating to the specific kind of component 3 to be processed in the specific apparatus 1 by conducting the deforming method without varying the distance between the rolling tools 4, 5. For this purpose, the blank diameters of components 3 of different blank diameters are processed in the apparatus 1 by rolling, and the resulting finished part diameters are sensed and determined by a measuring unit. The adjustment values are then determined based on the difference between the desired diameter of the finished part and the actual diameter of the finished part. It has been found to be advantageous to choose a plurality of diameter classes or groups, to classify the diameters according to the diameter classes, and to associate different adjustment values with each one of the diameter classes. Depending on the permissible variation or tolerance of the diameter of the finished part compared to the permissible variation or tolerance of the blank diameters, the blank diameters are classified in more or fewer classes. For example, in case the variations of the blank diameters are great and/or the accepted tolerances of the diameter of the finished parts are small, one chooses a comparatively great number of classes. These classes are then used for the mass production of a specific kind of a component 3 to be processed in the specific apparatus 1.

Preferably, the outer diameter of a finished part is sensed and determined as the diameter of the finished part. Depending on the requirements to the component 3, it is also possible to use a different location of the component 3 for measuring purposes, for example the flank diameter or the core diameter of a thread or of a profiled section of the component 3.

Due to the desired control of the distance between the at least two rolling tools 4, 5 in response to an adjustment value being derived from the blank diameter of the component, it is possible to accept greater tolerances and variations of the blank diameter of the component since elasticity of the apparatus 1 (which can never be reduced to zero) is almost completely compensated by the control operation. Furthermore, it is possible to design the apparatus 1 to have a more simple structure, for example by not using elements for stiffening purposes and decoupling purposes. Thus, the production costs of the apparatus 1 can be reduced compared to prior art apparatuses.

Figure 6:
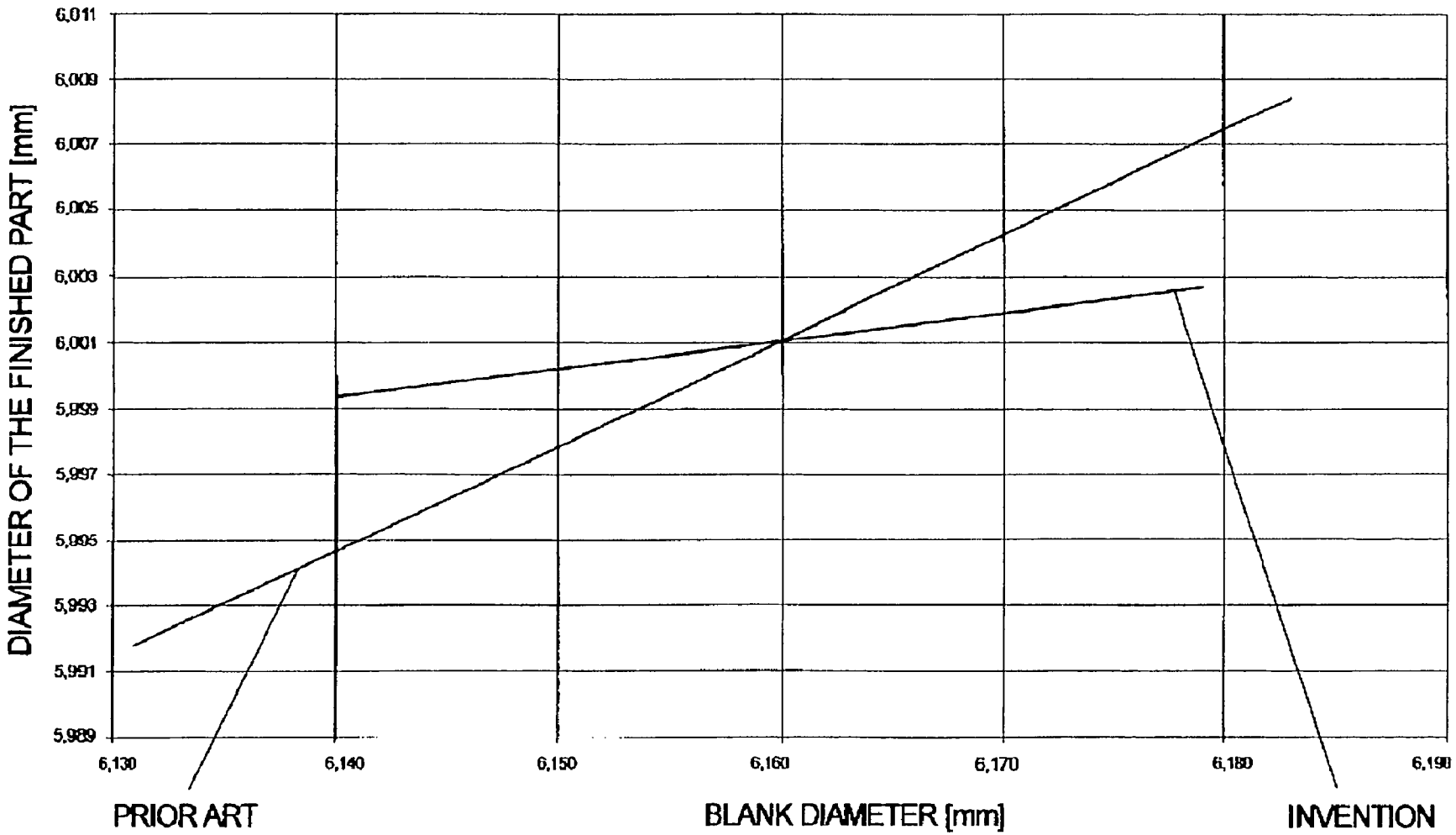
FIG. 6 is a diagram illustrating the blank diameter of a component versus the finished part diameter of the component both according to the novel method and the prior art.

The advantages which may be realized by the novel apparatus 1 compared to prior art apparatuses may be especially seen from the diagram according to FIG. 6. FIG. 6 illustrates the blank diameter of the component 3 on the vertical axis and the diameter of the finished part on the horizontal axis. The straight line being designated with "prior art" makes it clear that the diameter of the finished part increases in an approximately linear way with a comparatively great radiant when the blank diameter increases. This undesired effect is substantially reduced by the present invention, as this is to be well seen from the second line designated with "invention".

In this way, with the present invention, it is now possible to attain great exactness of the diameter of the finished part of the component 3 even when there are great variations of the blank diameters of the component 3 without having to take special measures with respect to the stiffness of the apparatus 1. Thus, the requirements of process safety are fulfilled. For example, when using an outer diameter of the component 3 of approximately 22 mm, an exactness of ±10 μm of the finished part diameter of the component 3 can be attained. When using an outer diameter of the component 3 of approximately 8.5 mm, for example, an exactness of ±5 μm of the finished part diameter of the component 3 can be securely realized.

Figure 7:
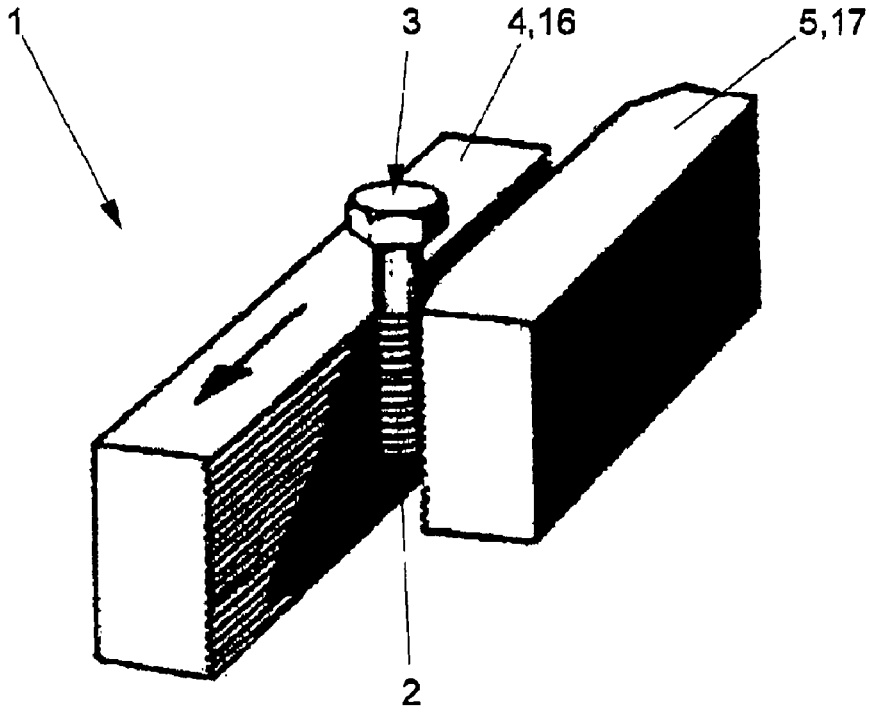
FIG. 7 is a schematic view of another novel apparatus for precision rolling of the surface area of a rotationally symmetrical component.

FIG. 7 schematically illustrates the general structure of another novel apparatus 1 for precision rolling of the surface area 2 of a rotationally symmetrical component 3. In this case, the component 3 is designed as a screw. In this exemplary embodiment, the apparatus 1 includes rolling tools 4, 5 being designed as profiled flat dies 16, 17 of which the movable flat die 16 is moved with respect to the stationary flat die 17 in a translatory way to produce the thread of the screw. The distance between the flat dies 16, 17 is varied by the control principle according to the invention in a direction perpendicular to the moving direction.

Figure 8:
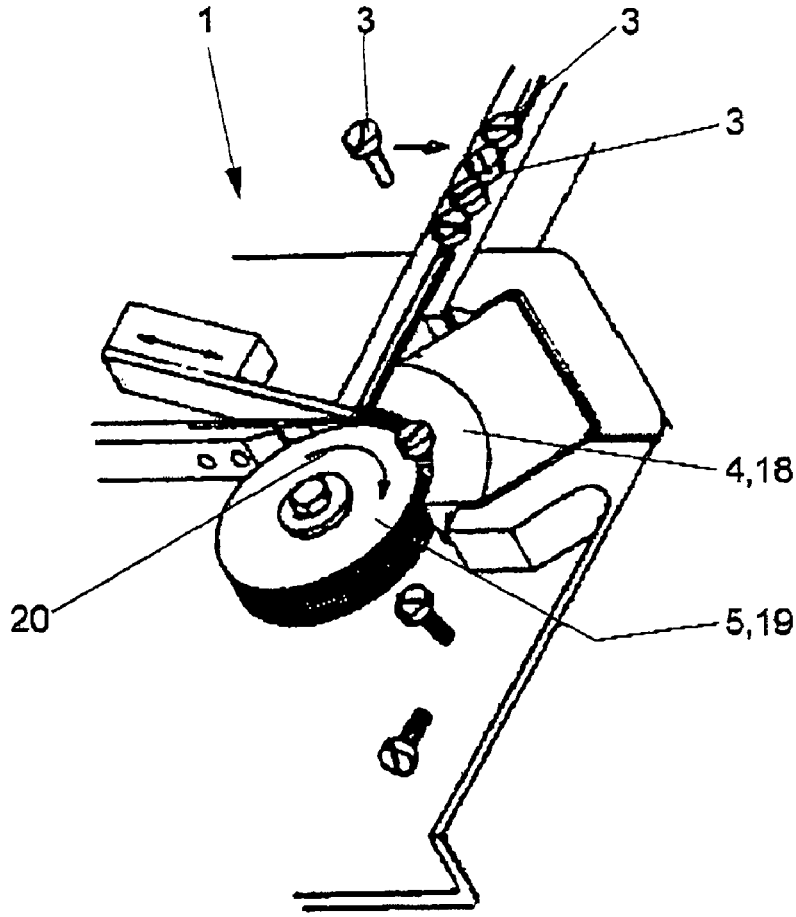
FIG. 8 is a schematic view of another novel apparatus for precision rolling of the surface area of a rotationally symmetrical component.

FIG. 8 illustrates the general structure of another exemplary embodiment of the novel apparatus 1 for precision rolling of the surface area 2 of a rotationally symmetrical component 3. In this case, the component 3 is designed as a screw. The apparatus 1 includes rolling tools 4, 5 being designed as a profiled segment 18 and a profiled roller 19. The roller 19 is moved with respect to the stationary segment 18 in a rotary way according to arrow 20 to produce the threat of the screw. The distance between the roller 19 and the segment 18 is varied according to the novel control method.

Many variations and modifications may be made to the preferred embodiments of the invention without departing substantially from the spirit and principles of the invention. All such modifications and variations are intended to be included herein within the scope of the present invention, as defined by the following claims.

We claim:

1. An apparatus for precision rolling of a surface area of a rotationally symmetrical component, comprising:

at least two spaced apart rolling tools;

a unit for determining an actual blank diameter of the component, the blank diameter being a diameter of the component before rolling;

a unit for comparing the determined actual blank diameter of the component with a predetermined blank diameter and for determining an adjustment value from the result of the comparison; and a control unit for adjusting a distance between said at least two rolling tools in response to the adjustment value.

2. The apparatus of claim 1, wherein said unit for determining the actual blank diameter of the component is designed as a measuring unit.

3. The apparatus of claim 1, wherein said unit for determining the actual blank diameter of the component is designed as an interface to a measuring unit.

4. The apparatus of claim 1, wherein said unit for comparing the actual blank diameter of the component with a predetermined blank diameter and for determining an adjustment value from the result of the comparison is designed as an evaluating unit.

5. The apparatus of claim 2, wherein said unit for comparing the actual blank diameter of the component with a predetermined blank diameter and for determining an adjustment value from the result of the comparison is designed as an evaluating unit.

6. The apparatus of claim 3, wherein said unit for comparing the actual blank diameter of the component with a predetermined blank diameter and for determining an adjustment value from the result of the comparison is designed as an evaluating unit.

7. The apparatus of claim 1, wherein said unit for comparing the actual blank diameter of the component with a predetermined blank diameter and for determining an adjustment value from the result of the comparison is designed as an interface to an evaluating unit.

8. The apparatus of claim 2, wherein said unit for comparing the actual blank diameter of the component with a predetermined blank diameter and for determining an adjustment value from the result of the comparison is designed as an interface to an evaluating unit.

9. The apparatus of claim 3, wherein said unit for comparing the actual blank diameter of the component with a predetermined blank diameter and for determining an adjustment value from the result of the comparison is designed as an interface to an evaluating unit.

10. The apparatus of claim 4, wherein said evaluating unit is designed and arranged to associate the determined actual blank diameter of the component to a specific group of a plurality of groups, each of said groups containing a specific adjustment value.

11. The apparatus of claim 7, wherein said evaluating unit is designed and arranged to associate the determined actual blank diameter of the component to a specific group of a plurality of groups, each of said groups containing a specific adjustment value.

12. The apparatus of claim 10, wherein said evaluating unit is designed and arranged to determine the adjustment values based on a comparison of a determined actual finished part diameter of the component with a predetermined desired finished part diameter for each one of the plurality of groups.

13. The apparatus of claim 11, wherein said evaluating unit is designed and arranged to determine the adjustment values based on a comparison of a determined actual finished part diameter of the component with a predetermined desired finished part diameter for each one of the plurality of groups.

14. The apparatus of claim 2, wherein said measuring unit is designed as a mechanical measuring unit.

15. The apparatus of claim 2, wherein said measuring unit is designed as an optical measuring unit.

16. An apparatus for rolling a surface area of a rotationally symmetrical component, comprising:

at least two spaced apart rolling tools, said rolling tools being designed and arranged to machine at least a section of the surface area of the component by rolling, said rolling tools being designed and arranged such that a distance between said rolling tools is adjustable by moving said rolling tools with respect to one another;

a measuring unit, said measuring unit being designed and arranged to determine an actual blank diameter of the component, the blank diameter being a diameter of the component before rolling;

an evaluating unit, said evaluating unit being designed and arranged to associate the determined actual blank diameter of the component to an adjustment value, the adjustment value being contained in a specific group of a plurality of groups, each of the groups being associated with a plurality of predetermined blank diameters of the component; and a control unit, said control unit being designed and arranged to adjust the distance between said at least two rolling tools depending on the adjustment value.

17. A method of precision rolling of a surface area of a rotationally symmetrical component, said method comprising the steps of:

determining an actual blank diameter of the component, the blank diameter being a diameter of the component before rolling;

comparing the determined actual blank diameter of the component with a predetermined blank diameter;

determining an adjustment value from the result of the step of comparing;

adjusting a distance between at least two rolling tools in response to the adjustment value; and machining at least a section of the surface area of the component by rolling.

18. The method of claim 17, wherein said steps of comparing and determining include the steps of:

associating the determined actual blank diameter of the component to an adjustment value, the adjustment value being contained in a specific group of a plurality of groups, each of the groups being associated with a plurality of predetermined blank diameters of the component.

19. The method of claim 18, further comprising the following step before the step of determining the actual blank diameter of the component:

determining the adjustment values based on a comparison of a determined actual finished part diameter of the component with a predetermined desired finished part diameter for each one of the plurality of groups.

20. The method of claim 17, wherein said component is a fastener.

21. The method of claim 20, wherein said fastener is a screw.

22. The method of claim 20, wherein a profiled section of the fastener is produced in said step of machining.

* * * * *